United States Patent [19]

Reddy

[11] 4,300,507

[45] Nov. 17, 1981

[54] SYSTEM CONTROLLING ANY AIR/FUEL RATIO WITH STOICHIOMETRIC SENSOR AND ASYMMETRICAL INTEGRATION

[75] Inventor: Junuthula N. Reddy, Troy, Mich.

[73] Assignee: The Bendix Corporation, Southfield, Mich.

[21] Appl. No.: 909,077

[22] Filed: May 24, 1978

Related U.S. Application Data

[60] Division of Ser. No. 791,092, Apr. 26, 1977, which is a continuation of Ser. No. 553,050, Feb. 25, 1975.

[51] Int. Cl.[3] ..... F02D 5/00

[52] U.S. Cl. ..... 123/489; 60/276

[58] Field of Search ..... 123/32 EE, 32 EA, 119 R, 123/119 EC; 60/276, 285

[56] References Cited

U.S. PATENT DOCUMENTS

| | | | |
|---|---|---|---|
| 3,782,347 | 1/1974 | Schmidt et al. | 123/119 R |
| 3,831,564 | 8/1974 | Schmidt et al. | 123/32 EA |
| 4,073,269 | 2/1978 | Herth et al. | 123/32 EE |

OTHER PUBLICATIONS

H. Eisele: "Electronic Fuel Injection in Europe", Paper presented at International Colloquium on Automotive Electronics Technology—Convergence 1974, Troy, Mich., Oct. 1974.

J. Camp et al.: "Closed-Loop Electronic Fuel and Air Control of Internal Combustion Engines", SAE paper at Automotive Engineering Congress and Exposition, Feb. 24–28, 1975, Detroit, Mich.

*Primary Examiner*—Parshotam S. Lall

*Attorney, Agent, or Firm*—Markell Seitzman; Russel C. Wells

[57] ABSTRACT

In a fuel management system for an internal combustion engine, a system utilizing a stoichiometric gas sensor in the exhaust gas system for supplying an electrical signal to an asymmetrical integrator which controls and maintains any desired air/fuel ratio to the engine. By means of the system, the air/fuel ratio may be maintained slightly richer than stoichiometric for optimum catalytic converter operation. For very lean air/fuel ratios, a delay circuit is used in the system to continue the time the fuel mixture is in a lean condition before the mixture is controllably changed to a rich mixture for sensing by the sensor.

6 Claims, 6 Drawing Figures

FIG. 1
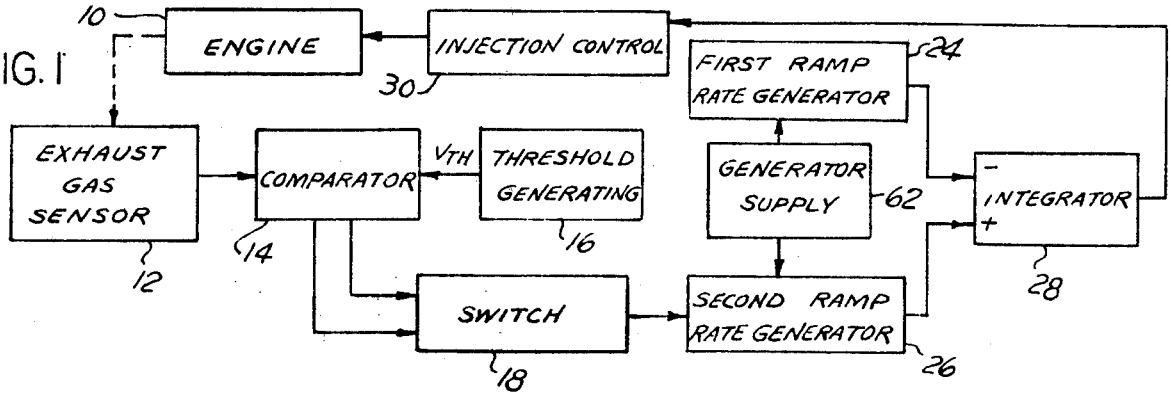
FIG. 2
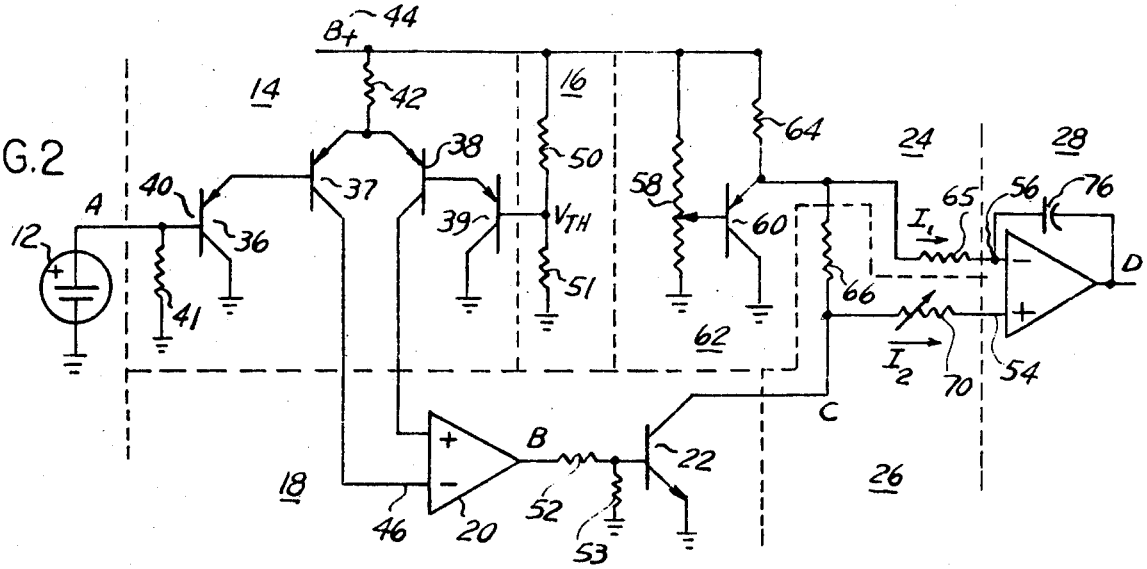
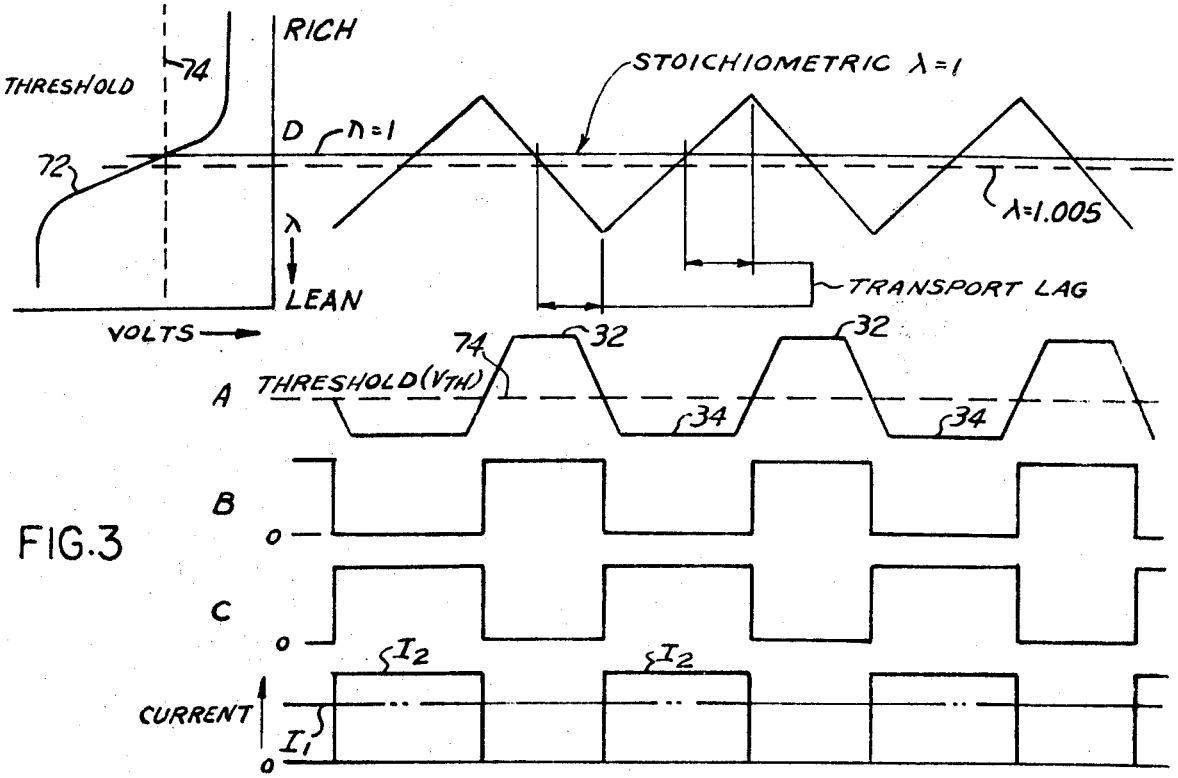
FIG. 3

SYSTEM CONTROLLING ANY AIR/FUEL RATIO WITH STOICHIOMETRIC SENSOR AND ASYMMETRICAL INTEGRATION

CROSS-REFERENCE TO RELATED CASES

The present application, is a division of application Ser. No. 791,092 filed on Apr. 26, 1977 which is a continuation of application Ser. No. 553,050 filed on Feb. 25, 1975.

BACKGROUND OF THE INVENTION

A. Field of the Invention

In general this invention relates to fuel management systems for internal combustion engines and in particular to systems utilizing exhaust gas sensors for controlling and maintaining any desired fuel/air ratio in a fuel injection system.

B. Prior Art

In U.S. Pat. No. 3,815,561 issued to Seitz and entitled "Closed Loop Engine Control System" the system described therein is responsive to signals indicative of the presence or absence of oxygen in the exhaust gas of the engine. The control system is then operative to generate an output signal for receipt by the fuel delivery controller which will cause that controller to increase fuel delivery in the presence of oxygen molecules and to decrease fuel delivery in the absence of oxygen molecules. Thus, in response to the output signal the controller attempts to maintain fuel delivery at a predetermined and in particular stoichiometric air/fuel ratio mixture point.

U.S. Pat. No. 3,789,816 issued to Taplin et al. and entitled "Lean Limit Internal Engine Roughness Control System" describes a closed loop fuel control mechanism for controlling the air/fuel mixture delivered to an internal combustion engine. The purpose of this system is to regulate the roughness of the engine at a predetermined level by controlling the fuel delivery mechanism so that the engine is operated at the leanest possible air/fuel mixture ratio compatible with a predetermined level of engine roughness.

Most systems teach the use of a single sensor which is responsive to one predetermined air/fuel ratio in order to maintain the system at that air/fuel ratio. As indicated above when such sensor is an oxygen gas sensor of a particular type it generates a step voltage signal at a particular air/fuel ratio which is stoichiometric. Functionally the output of the sensor is supplied to an integrator circuit having an output that is symmetrical as respects to charge and discharge times thereby allowing the fuel controller to operate equally on both sides of the stoichiometric point.

SUMMARY OF THE INVENTION

In a fuel injection system having at least one electrically operated fuel injector valve for injecting fuel into an internal combustion engine, the system responds to the exhaust gas composition maintaining a predetermined lean air/fuel ratio. The system comprises an exhaust gas sensor positioned in the exhaust system of the internal combustion engine and responsive to one of the constituent gases at a predetermined air/fuel ratio. The output of the exhaust gas sensor is either one of two levels for indicating the presence or absence of the constituent exhaust gas. The threshold voltage generator means generates an electrical signal intermediate the output levels of the exhaust gas sensor. The output of the sensor and the output threshold generator means are supplied to a comparator for generating an output signal as a result of the comparison. A delay circuit is electrically connected to the output of the comparator and is responsive to the output signal therefrom indicating a change from a rich to a lean air/fuel mixture. In response to the change, the delay circuit generates a control pulse having a time proportional to the desired lean air/fuel ratio. A pair of ramp-rate generators are used as a current supply to supply a predetermined amount of current upon their actuation. An asymmetrical integrator having two inputs for respectively receiving the current from the two ramp-rate generators generates an output electrical signal having a positive-going ramp slope and a negative-going ramp slope. Each ramp slope has a time constant proportional to the amount of current supplied by either of said ramp rate generators. A switch means is interposed in the circuit between the delay circuit and the integrator for controlling the amount of current being supplied to the integrator from one of the ramp-rate generators. The switch is responsive to the output signal generated by the delay circuit and is actuated during the time period of the delay. The output of the integrator is supplied to the injector control means for controlling the operational time of the electro-machanical injector. Thus, by averaging the output waveshape from the integrator means a predetermined lean air/fuel ratio may be maintained by using a stoichiometric responsive gas sensor.

DESCRIPTION OF THE DRAWINGS

In the drawings:

FIG. 1 is a block diagram of a system for controlling the air/fuel ratio of an internal combustion engine;

FIG. 2 is the schematic of the major portion of the system of FIG. 1;

FIG. 3 is an illustration of the voltage and current waveshapes at several points of the schematic of FIG. 2;

DETAILED DESCRIPTION

Figure 4:
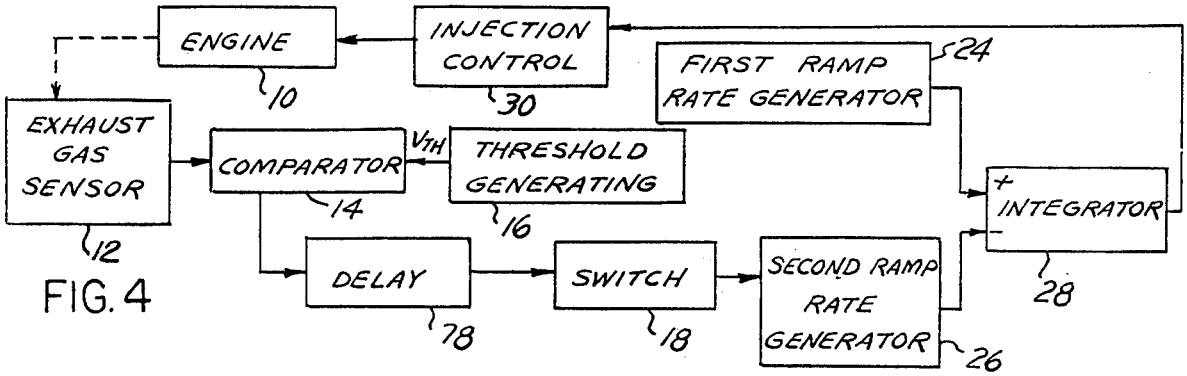
FIG. 4 is the block diagram of another embodiment of the system of FIG. 1, more particularly for operating a lean air/fuel ratio.
Figure 5:
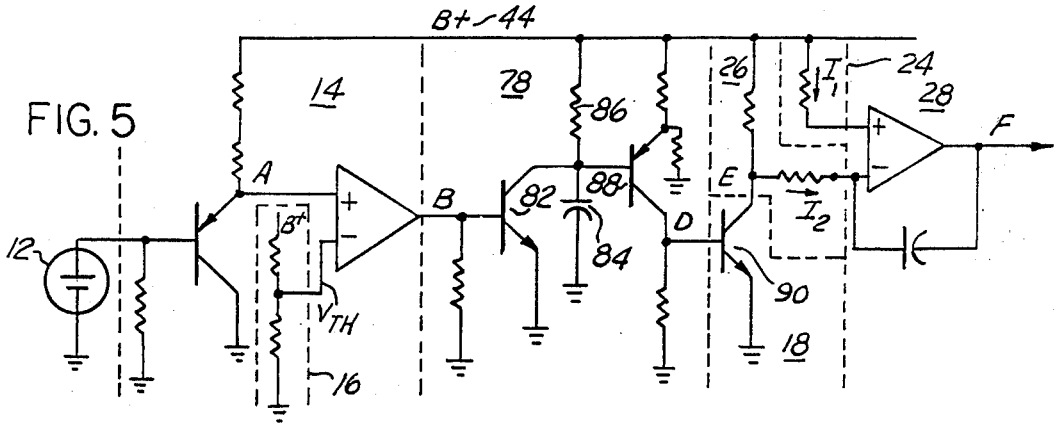
FIG. 5 is a schematic of the major portion of the block diagram of FIG. 4.

Referring to the Figs. by the characters of reference there is illustrated in FIG. 1 a block diagram of a system for controlling the air/fuel ratio in a fuel injection control system for an internal combustion engine 10. While in the preferred embodiment the engine used is a spark ignited engine, the system described herein is independent of the type of engine used and a compression ignited engine may also be used. In particular, the system of FIG. 1 uses an exhaust gas sensor 12 positioned in the exhaust system of an internal combustion engine 10 for controlling the air/fuel ratio of the fuel mixture supplied to the intake of the internal combustion engine.

The system of FIG. 1 comprises an exhaust gas sensor 12 positioned in the exhaust system of a spark ignited internal combustion engine 10 for generating an electrical signal having either one of two voltage levels in response to one of the constituent gases in the exhaust. This electrical signal is connected to one input of a comparator means 14. The second input to the comparator means 14 is from a threshold voltage generating means 16. The threshold voltage generating means 16 generates a voltage signal intermediate of two voltage levels of the sensor 12.

The output of the comparator 14 is electrically connected to a switch means 18 including an operational amplifier 20 (FIG. 2) functioning as a differential amplifier and a switching transistor 22 (FIG. 2). The function of the switch means 18 is to select either one of the two ramp rate generators 24 or 26 and effectively connect the selected generator to the input of an integrator means 28. The output of the integrator means 28 is a varying voltage signal which is supplied to a injection control means 30 for controlling the operational time of the several fuel injectors of the engine 10 for regulating the amount of fuel supplied to the engine 10 at its intake.

As the engine 10 burns the fuel mixture, the resultant exhaust gas will travel through the exhaust system and the desired constituent gas will be sensed by the exhaust gas sensor 12. This travel time between the cylinder and the sensor 12 will hereinafter be identified as transport lag. Thus, the system illustrated in FIG. 1 is a closed loop control system for maintaining a desired air/fuel ratio.

The schematic of FIG. 2 illustrates the electrical connections between the several blocks of FIG. 1 from the exhaust gas sensor 12 through and including the integrator means 28. The output signal, waveshape FIG. 3D, from the integrator means 28 of FIG. 2, is supplied to the injection control means 30 as shown in FIG. 1.

The exhaust gas sensor 12 of FIG. 2 will generate a signal having either one of two voltage levels wherein the first voltage level, in the preferred embodiment the upper voltage level 32 (FIG. 3A), indicates the absence of the desired constituent gas in the exhaust gas passing the sensor 12. The second or lower voltage level 34 in the preferred embodiment indicates the presence of the desired constituent gas in the exhaust gas. In the preferred embodiment the exhaust gas sensor 12 is an oxygen gas sensor wherein the first voltage level 32 represents a rich air/fuel mixture and the second voltage level 34 indicating a lean air/fuel mixture. The voltage output of the sensor 12 switches between the two levels at stoichiometric air/fuel ratio or as illustrated in FIG. 3D $\lambda=1$. Lambda, $\lambda$, is defined as the dimensionless number found by dividing the present air/fuel ratio to the air/fuel ratio at stoichiometric conditions.

The comparator comprises four transistors 36–39 wherein the sensor 12 is electrically connected to a bias resistor 41 and to the base 40 of the first transistor 36 having its collector lead grounded and its emitter lead electrically connected to the base lead of the second transistor 37. The second transistor 37 has its emitter lead electrically connected through a resistor 42 to a source of voltage 44 and to the emitter lead of the third transistor 38 and its collector lead electrically connected to the inverting input 46 of an operational amplifier 20 in the switch means 18. As illustrated in the waveshapes A and B of FIG. 3, the signal at the output of the operational amplifier 20 is substantially identical to the signal at the output of the exhaust gas sensor 12; however, the output signal is amplified and shaped into a rectangular shape.

As previously indicated, the other input to the comparator 14 is electrically connected to the threshold voltage generating means 16 comprising a voltage divider network of two resistors 50 and 51 for generating the threshold voltage signal. The output of the threshold voltage generating means 16 is electrically coupled to the fourth transistor 39. In particular, the threshold voltage level is selected from the pair of resistors 50 and 51 in the voltage divider network and is electrically connected through the fourth transistor 39 to the third transistor 38. Typically, the threshold voltage is intermediate of the signal from the exhaust gas sensor 12. In the preferred embodiment, the output of the exhaust gas sensor 12 is 800 millivolts in a rich exhaust gas and less than 200 millivolts in a lean exhaust gas and the threshold voltage signal is approximately 380 millivolts.

The output of the operational amplifier 20 is electrically connected through a resistor 52 to a bias resistor 53 and to the base lead of the switching transistor 22. The switching transistor 22 is connected in a grounded emitter configuration and when the exhaust gas is rich, the transistor 22 is in conduction and the switch is actuated.

The ramp rate generators 24 and 26 function to supply the necessary amount of current $I_1$ and $I_2$ to predetermined inputs of the integrator 28 in accordance with the quality of the exhaust gas being sensed by the sensor 12. As illustrated in FIG. 2, the second ramp rate generator 26 supplies its current output $I_2$ to the noninverting input 54 of the operational amplifier integrator 28 and the first ramp generator 24 supplies its output current, $I_1$, to the inverting input 56 of the integrator 28. The total amount of current supplied to the two ramp rate generators, $I_1+I_2$, is controlled by a voltage divider 58 in the base lead of a grounded collector transistor 60 in the generator supply 62. The emitter lead of the transistor 60 is electrically connected through a resistor 64 to the source of supply 44 and is also electrically connected to a pair of resistors 65 and 66 in the first and second ramp rate generators 24 and 26. The first resistor 65 is electrically connected to the inverting input 56 of the integrator for supplying the current $I_1$, and the second resistor 66 is electrically connected to the collector lead of the switch transistor 22. From the junction of the second resistor 66 and the collector of the switch transistor 22, a variable resistor 70 for supplying the current $I_2$ is electrically connected to the noninverting input 54 of the integrator 28. The variable resistor 70 provides an adjustment range of current, $I_2$, for a lean or rich air/fuel mixture and as will hereafter be shown, will change the slope of the upward ramp of FIG. 3D.

As illustrated in FIG. 2 the voltage divider 58 connected to the base lead of the transistor 60 in the ramp rate generator supply 62 operates to control the speed of the two ramp rate generators 24 and 26. A control signal completely responsive to high load conditions or high air flow conditions can be coupled into the transistor 60 of the generator supply 62 and be used to change the speed of both ramp generators and still maintain the desired asymmetry because the ratio between the current $I_1$ and $I_2$ remain the same. Conversely in the presence of a low load or low air flow condition a control signal coupled into the transistor 60 can be used to decrease the speed of both ramp generators 24 and 26 by reducing the total amount of current, $I_1+I_2$, from the generator supply 62. As previously indicated, the voltage divider 58 controls the speed of the ramp rate generator. The resistor 65 controls the slope of the integrator 28 in the rich fuel mixture operation and the resistors 66 and 70 electrically connected to the noninverting input of the integrator controls the slope of the integrator 28 in the lean fuel mixture operation. Additionally, in the preferred embodiment the total resistance electrically connected between the emitter of the generator supply 62 and the inverting input 56 of the integrator 28 is greater than the sum of the two resistors 66 and 70, and thus electrically connected to the noninverting input 54 of the integrator 28. When the switch 18 is actuated, the input to the variable resistor 70, and thus to the noninverting input 54, is substantially at ground and $I_2$ is substantially zero and the steady current $I_1$, in FIG. 2, causes the output slope of the integrator 28 to be negative.

Referring to FIG. 3, the operation of the circuit of FIG. 2 will be explained. On the upper left side of the FIG. 3D is a typical curve 72 of the output voltage of an exhaust gas sensor for various air/fuel ratios expressed in terms of lambda "λ". The curve 72 is rotated clockwise 90° for purposes of illustration. The threshold voltage level 74 indicated on the graph is applicable for all sensors regardless of age, or internal characteristics and intersects the curve at stoichiometric conditions or as identified on the graph at $\lambda=1$. Such a sensor is one described in U.S. Pat. No. 3,815,561 issued to William R. Seitz entitled "Closed Loop Engine Control System" and assigned to a common assignee. The Seitz patent is incorporated herein by reference.

The system in FIGS. 1 and 2 is particularly adaptable for operating the engine with an air/fuel ratio of $\lambda=0.995$ which is slightly rich of stoichiometric. This λ condition is a favored air/fuel ratio for catalytic converters as used in the exhaust gas systems. The system in FIGS. 1 and 2 is also particularly adaptable for operating the engine with an air/fuel ratio of 1.005 which is slightly lean of stoichiometric. This lean λ condition is favorable for economical operation.

As illustrated in waveshape D of FIG. 3, which is functionally the output of the integrator 28, the upward, positive or charging ramp time constant is substantially longer than the downward, negative or discharging ramp thime constant. Thus, the output of the integrator 28 is asymmetrical as the charging and discharging times of the capacitor 76 are much different. In the waveshape D of FIG. 3 the upper point of the triangular waveshape is operating in the rich air/fuel ratio area of the curve. Thus, using the horizontal line representing $\lambda=1.005$ the area under the curves of the two triangles is equal thereby giving an average air/fuel ratio which is greater than the stoichiometric air/fuel ratio; or with $\lambda=0.995$, the air/fuel ratio is less than 14.8 which is approximately the stoichiometric air/fuel ratio.

The waveshape D of FIG. 3 is the result of the processing of the signal generated from the exhaust gas sensor 12 through the circuitry and outputing from the integrator 28 to injection control circuit 30. The injection control circuit 30 is conventional and can, for example, comprise the fuel delivery controller 50 of the hereinbefore incorporated Seitz U.S. Pat. No. 3,815,561. As is evident, the integrator 28 maybe connected by its output lead to the base of transistor 109 in FIG. 3 of that reference. Waveshape A represents the voltage output of the exhaust gas sensor 12 responding to a characteristic of the exhaust gas passing through the system and by the sensor 12. Waveshape B is substantially the voltage waveshape taken at the output of the operational amplifier 20 in the switch means 18 and is substantially the waveshape at the output of the exhaust gas sensor 12 except for shaping and amplification. The main function of the operational amplifier 20 is to operate as a speed-up and shaping device in that its output switches at essentially the threshold level 74 of the sensor 12. Waveshape C is the output voltage waveshape of the switch means 18 and is the inversion of Waveshape B. With the transistor switch 22 in conduction, the voltage at point C is substantially ground and the current $I_2$ is substantially zero. When the transistor 22 is out of conduction, the current $I_2$ is greater than the current $I_1$. If $I_2=2I_1$, then the output of the integrator 28 is symmetrical, however, at all other values of $I_2$ the integrator output is asymmetrical. For example, with $I_2<2I_1$ (as illustrated in the present waveform) the asymmetrical output of the integrator 28 will cause a lean air/fuel ratio. If, however, resistor 70 is adjusted such that $I_2>2I_1$ then a rich air/fuel ratio will result.

In operation of the circuit of FIG. 2 the amount of current being supplied to either of the inputs of the integrator determines the output characteristic of the integrator. When the current $I_2$ is zero, the current $I_1$ effectively discharges the capacitor 76. The current flow through the capacitor 76 is from the inverting input 56 through the capacitor 76 to the output of the integrator 28. This results in the output voltage of the integrator 28 discharging or producing a downward ramp or negative slope.

However, when the current $I_2$ is equal to $I_1+\Delta I_1$, the integrator 28 tries to balance the input currents to zero and the $\Delta I_1$ current then flows to charge the capacitor 76 and the output voltage of the integrator is charging or producing an upward ramp or positive slope. In essence, the current $\Delta I_1$ flows from the output of the integrator 28 through the capacitor 76 to the inverting input 56.

The bottom waveshape of FIG. 3 is a graphic illustration of the currents $I_1$ and $I_2$. It is seen that the current $I_1$ is always constant and the current $I_2$ is a pulsating current. Another feature is that the current $I_2$, when flowing, is always greater than the current $I_1$.

The following table identifies the component values of the circuit of FIG. 2.

| | | | |
|---|---|---|---|
| 20 | ½ MXC3401P | 37 | 2N2605 |
| 22 | 2N3415 | 38 | 2N2605 |
| 28 | ½ MXC3401P | 39 | 2N2605 |
| 41 | 1 megohm | 42 | 390kΩ |
| 36 | 2N2605 | 44 | 9.5v |
| 50 | 68kΩ | 60 | 2N3702 |
| 51 | 20k(variable) | 64 | 3000Ω |
| 52 | 33kΩ | 65 | 130kΩ |
| 53 | 10kΩ | 66 | 6200Ω |
| 58 | 20kΩ | 70 | 100kΩ |
| | | 76 | 6.8μf |

Figure 6:
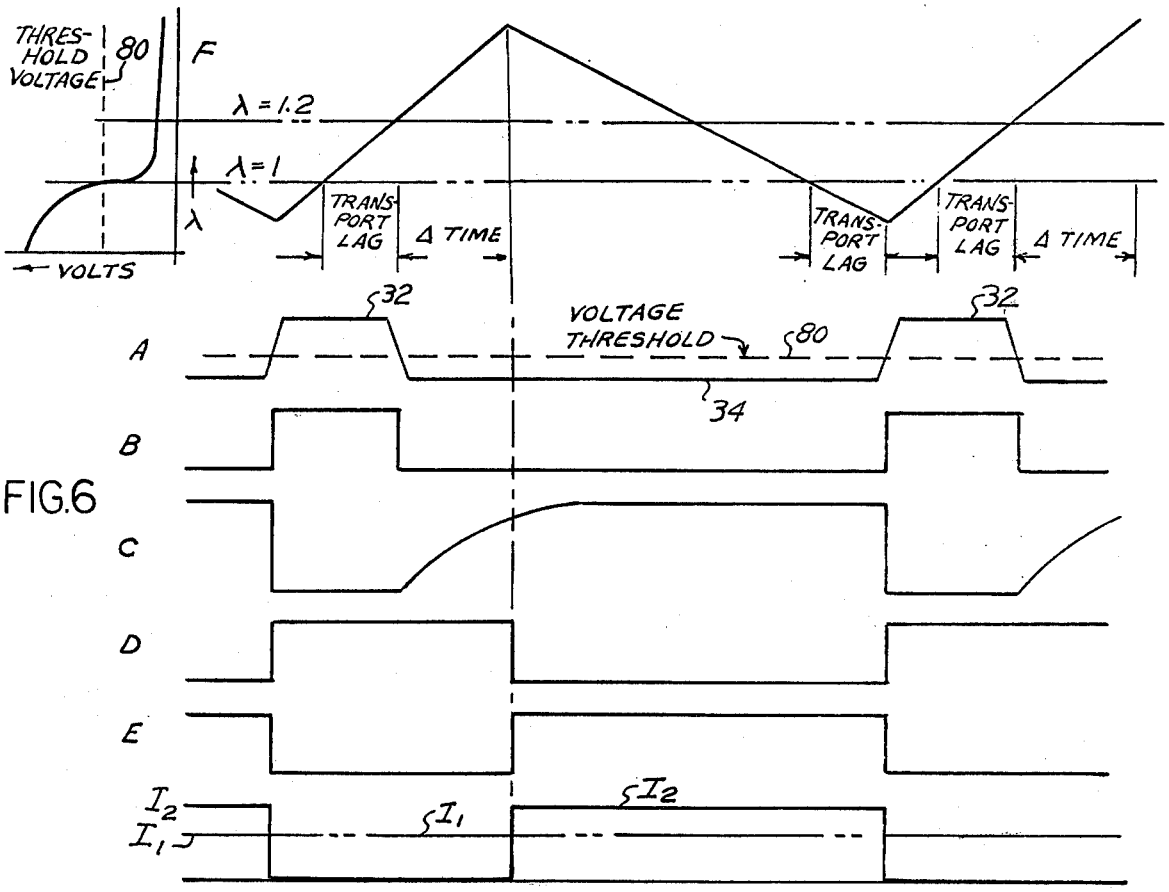
FIG. 6 are illustrations of the voltage and current waveshapes at several points of the schematic of FIG. 5.

Referring to FIG. 4 there is illustrated in block diagrammatic form another embodiment of the system of FIG. 1 wherein similar blocks are identified as in FIG. 1. In this particular embodiment the output of the comparator 14 is supplied to a delay circuit 78 wherein a control pulse signal is generated for actuating the switch means 18. The delay 78 is responsive to the signal generated by the comparator 14 when the exhaust gas sensor 12 senses the changing of the fuel mixture from a rich to a lean air/fuel mixture. As illustrated in Waveshape B of FIG. 6 when the exhaust gas sensor 12 waveshape, Waveshape A, crosses the threshold voltage level 80 during a rich to lean mixture transistion, the output of the comparator 14 switches from one voltage level to a less positive voltage or approximately ground. This drives the first transistor 82 of the delay circuit 78 out of conduction and allows the capacitor 84 to charge through its charging resistor 86 from the power source 44. This is illustrated in Waveshape C of FIG. 6. As the voltage on the capacitor 84 approaches the supply voltage it drives the second transistor 88 of the delay circuit 78 out of conduction thereby removing the voltage from the base lead of the switch transistor 90. The functional or operational result of placing the delay in the circuit is to continue the operation of the engine 10 in the lean fuel mixture area of the curve for a longer period of time before changing the fuel mixture to a rich direction. This is illustrated in Waveshape F of FIG. 6 wherein the result of the operation of this embodiment is to operate the internal combustion engine 10 at an average lean air/fuel mixture while at the same time using a stoichiometric activated sensor 12 by allowing spaced time portions of the air/fuel mixture to become rich. The integrator 28 is illustrated as connected to the injection control circuit 30 such that an increasing integrator voltage will increase the air/fuel ratio.

In both of the embodiments as illustrated in either FIG. 1 or FIG. 4 and as shown on the waveshape outputs of the integrator 28 there is a certain period of time identified as transport lag which is the time it takes for the fuel mixture injected into the input of the engine 10 and its resultant exhaust gas to reach the exhaust gas sensor placed in the exhaust system of the engine. And in particular referring to Waveshape D. of FIG. 3, when the output of the integrator 28 intersects the stoichiometric points the integrator continues for a period of time until the sensor senses the changed fuel mixture. This period of time is transport lag and it is present in both the charging and discharging slopes of the integrator output of either system of FIG. 1 or FIG. 4. Thus, by controlling the current inputs to an integrator, the charge and discharge times of the integrating capacitor can be varied and thus varying the average value of the output voltage from the integrator. This deliberate control of the integrator results in changing characteristics of the integrator from a symmetrical to asymmetrical integrator. By proper control, any desired average fuel-/air ratio can be achieved by using a sensor which has a stepped output characteristic at only one predefined air/fuel ratio such as stoichiometric.

I claim:

1. A fuel-air control system for an internal combustion engine, including a controller with integral control characteristic for controlling the fuel-air mixture admitted to the engine (λ -control process) and including an oxygen sensor, located in the exhaust system of the engine, and capable of providing an output signal; the improvement in said fuel-air system comprising:

a comparator circuit, for comparing said output signal from said oxygen sensor with a reference value and providing an output signal;

an integrating circuit, whose control signal input is connected to the output from said comparator circuit and which delivers a changeable output signal;

a flip-flop circuit, including a monostable multivibrator whose control input is connected to the output from said comparator circuit according to which output the multivibrator is set and which delivers an output signal that is connected to the input of said integrating circuit the output signal from said flip-flop circuit inhibits the transmission of one of said output signals from said comparator to said integrating circuit for delaying the change of its output signal in one direction for a period of time corresponding to the time constant of the monostable multivibrator, thereby delaying in one direction the response of said integrating circuit to changes in the output signal from said oxygen sensor;

a control unit, connected to the output from said integrating circuit, for providing injection valve control signals; and an air-fuel rate adjusting device connected to said control unit.

2. A fuel-air control system according to claim 1, the improvement further comprising:

a transistor, controlled by the output from said flip-flop circuit and connected to the input of said integrating circuit to define the electric potential at said input; whereby said electric potential may be held at ground level during the unstable state of said multivibrator when said output signal from said oxygen sensor makes a transition to a more positive voltage.

3. A fuel-air control system according to claim 1, the improvement further comprising:

a transistor, controlled by the output from said flip-flop circuit and connected to the input of said integrating circuit to define the electric potential at said input; whereby said electric potential may be held at high potential during the unstable state of said multivibrator when said output signal from said oxygen sensor makes a transition to a more negative voltage.

4. A fuel-air control system according to claim 1, further comprising:

switch means, connected between said flip-flop circuit and said integrating circuit; whereby the input of said integrating circuit may be electrically disconnected from said comparator circuit and from said flip-flop circuit.

5. A mixture control system for an internal combustion engine including means for supplying mixture of air and fuel thereto in a variable ratio depending upon a signal representative of the concentration of a predetermined constituent gas of the emissions from said engine, and an exhaust gas sensor for generating said signal having a sharp transition in amplitude in response to the presence of said predetermined constituent gas being above or below a predetermined value corresponding to an air-fuel ratio at or near stoichiometry, comprising:

means for generating a deviation signal representitive of the deviation of said transitional signal from a reference representing said predetermined air-fuel ratio, said deviation signal having first and second voltage levels depending upon whether said transitional signal is above or below said predetermined value;

means for extending the duration of said deviation signal at said first voltage level a predetermined time; and means for integrating said duration-extended deviation signal with time to generate a time integral signal.

6. A method of operating a closed-loop mixture control system at a desired air-fuel ratio in an internal combustion engine including an exhaust gas sensor operable to generate a signal having a sharp transition in amplitude between first and second voltage levels in response to the presence of a predetermined constituent gas being above or below a predetermined concentration in the emissions from said engine, comprising: the steps of comparing the transitional signal with a reference level representing a predetermined air-fuel ratio to generate a signal representing the deviation of said transitional signal from said reference level; integrating said deviation signal with time to generate a time integral signal having an amplitude varying in accordance with the direction of said deviation; and extending the duration of said deviation signal by a predetermined amount prior to said integration to permit said time integral signal to increase in amplitude corresponding to said predetermined amount, whereby said time integral signal fluctuates about a level different from said predetermined air-fuel ratio.

* * * * *